US007146942B2

(12) United States Patent
Yuasa et al.

(10) Patent No.: US 7,146,942 B2
(45) Date of Patent: Dec. 12, 2006

(54) TWO-CYCLE COMBUSTION ENGINE WITH AIR SCAVENGING SYSTEM HAVING PRESSURE REDUCING DEVICE

(75) Inventors: Tsuneyoshi Yuasa, Kobe (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/171,881

(22) Filed: Jun. 30, 2005

(65) Prior Publication Data

US 2006/0005795 A1 Jan. 12, 2006

(30) Foreign Application Priority Data

Jul. 8, 2004 (JP) ..... 2004-201466

(51) Int. Cl.
*F02B 25/00* (2006.01)

(52) U.S. Cl. ..... 123/73 PP; 123/65 P

(58) Field of Classification Search ..... 123/73 PP, 123/65 A, 65 P
See application file for complete search history.

(56) References Cited

FOREIGN PATENT DOCUMENTS

| | | |
|---|---|---|
| JP | 6-14453 | 2/1994 |
| WO | WO 2004/038195 | 5/2004 |

*Primary Examiner*—Noah P. Kamen

(57) ABSTRACT

To provide an improved air scavenging type two-cycle combustion engine equipped with a pressure reducing device in which clogging of a decompressing hole can easily be removed, a two-cycle combustion engine includes a delivery passage (32) for introducing air into a combustion chamber (9) prior to an air-fuel mixture. This delivery passage (32) has a downstream opening (32*c*) through which the air is introduced into the combustion chamber by way of a scavenging port (40*a*). A decompressing hole (38) is defined for communicating the combustion chamber (9) to a portion of the delivery passage (32) and is closed by a piston (16) then ascending, at a timing delayed relative to closure of an exhaust port (31).

14 Claims, 10 Drawing Sheets

TWO-CYCLE COMBUSTION ENGINE WITH AIR SCAVENGING SYSTEM HAVING PRESSURE REDUCING DEVICE

BACKGROUND OF THE INVENTION

1. Field of the Invention

The present invention generally relates to a two-cycle combustion engine having an air scavenging system, which can be utilized as a drive source for a small-size work machine such as, for example, a brush cutter or a blast cleaner. More particularly, the present invention relates to the two-cycle combustion engine of the type referred to above, having a pressure reducing device for discharging compressed gases within an engine cylinder.

2. Description of the Prior Art

The two-cycle combustion engine having an air scavenging system is well known in the art. Specifically, the conventional two-cycle combustion engine with the air scavenging system is generally so designed that prior to a combustion chamber being scavenged with an air-fuel mixture, the combustion chamber is initially scavenged with an air to suppress a blow-off of the air-fuel mixture through an exhaust port. In this conventional two-cycle combustion engine, for example, a pair of first scavenging passages and a pair of second scavenging passages are defined in part in the engine cylinder and in part in the crankcase, respectively, such that the air is temporarily introduced into the second scavenging passages and is subsequently supplied into the combustion chamber through the second scavenging passages prior to the air-fuel mixture being supplied into the combustion chamber through the first scavenging passages during the scavenging stroke. See, for example, International Publication No. WO2004/038195. According to the known construction described above, the air introduced into the combustion chamber through the second scavenging passage can effectively prevent the air-fuel mixture, once supplied through the first scavenging passage, from being blown off through the exhaust port.

Also, in order to reduce the driving torque necessary to start the combustion engine, Japanese Laid-open Utility Model Publication No. 6-14453, published Feb. 25, 1994, suggests the use of a decompressing groove that is defined in the wall of the cylinder block for driving the air-fuel mixture, compressed within the engine cylinder, out to the scavenging passage.

It has, however, been found that in the two-cycle combustion engine with the air scavenging system such as disclosed in the first mentioned Japanese publication, although both the amount of unburned gases being blown off and the fuel consumption are rendered small, the concentration of the air-fuel mixture within the engine cylinder tends to be lowered as a result of the scavenging with air, accompanied by lowering of the cooling performance exhibited by a fuel component and, therefore, the combustion chamber will not be sufficiently cooled when, for example, the combustion engine is abruptly decelerated from a fully loaded operating condition down to the idling speed. Due to such insufficient cooling of the combustion chamber, even after the ignition switch has been turned off to halt the engine, the temperature of the air-fuel mixture in the combustion chamber at the time of the start of compression remains high, resulting in the "run-on (or self ignition)" phenomenon, in which the combustion engine continues to fire. In view of the foregoing, it may be contemplated to employ the decompressing groove such as disclosed in the second mentioned Japanese publication to reduce the pressure in the combustion chamber during a low speed operation. However, it has been found that in this decompressing groove, a quantity of fuel deposited in the vicinity of an exit end thereof may be charred to form a carbon deposit, which constitutes a cause of clogging occurring in the vicinity of the exit end of the decompressing groove to such an extent as to result in closure of the decompressing groove. Once the decompressing groove is so closed, there is a high possibility that the pressure reducing effect may be lowered. Also, since the position at which the decompressing groove can be formed is limited to a site around the scavenging port, complicated and time-consuming procedures would be required to clean off the deposit clogging in the vicinity of the exit end of the decompressing groove.

SUMMARY OF THE INVENTION

Accordingly, the present invention is intended to provide an improved air scavenging type two-cycle combustion engine equipped with a pressure reducing device, which is effective to suppress the blow-off of the air-fuel mixture through the exhaust port and in which clogging of a decompressing hole can easily be removed, even though such clogging occurs, to thereby enhance the pressure reducing effect In order to accomplish the foregoing object, the present invention provides a two-cycle combustion engine with an air scavenging system, provided with a pressure reducing device, which combustion engine includes a delivery passage for introducing air into a combustion chamber prior to an air-fuel mixture. This delivery passage has a downstream opening through which the air is introduced into the combustion chamber by way of a scavenging port. A decompressing hole is defined for communicating the combustion chamber to a portion of the delivery passage and is closed by a piston then ascending, at a timing delayed relative to closure of an exhaust port.

According to the present invention, when the air-fuel mixture within the combustion chamber is compressed during the compression stroke in which the piston ascends, the decompressed hole is closed by the piston at a timing delayed relative to the closure of the exhaust port and, therefore, the air-fuel mixture can be expelled from the combustion chamber into the delivery passage through the decompressing hole during the compression stroke. Accordingly, the compression ratio is lowered and, hence, great increase of the temperature of the air-fuel mixture resulting from the compression of the air-fuel mixture does not take place. Hence, even though the ignition switch is turned off after deceleration to the idling operation, the temperature of the air-fuel mixture does not reach the temperature of self-ignition of the air-fuel mixture, thereby avoiding the occurrence of the "run-on" phenomenon.

Also, with the decompressing hole positioned at a proper location distant from the exhaust port, not only can the clogging of the decompressing hole be reduced, but the cleaning of the decompressing hole can also be facilitated. In addition, the engine starting can easily be accomplished with the pressure reduced during the compression stroke. Yet, since the air is introduced into the combustion chamber prior to the introduction of the air-fuel mixture, an undesirable blow-off of the air-fuel mixture through the exhaust port can advantageously be suppressed. On the other hand, when the combustion engine is operated at a high rotating speed, the time area (corresponding to the product of time multiplied by area) is small, that is, the number of revolutions of the combustion engine is far greater than that during the idling operation and the length of time during which the decompressing hole is opened by the piston is shortened. Accordingly, the compressed air-fuel mixture will not leak outwardly from the combustion chamber and, therefore, the combustion engine can be operated at the same high compression ratio as that during the high speed operation of the normal combustion engine without the decompressing hole, resulting in a large output.

The decompressing hole referred to above is preferably defined at a position confronting the exhaust port.

Positioning of the decompressing hole at that position confronting the exhaust port contributes to the combustion gases being purged to the outside through the exhaust port since during the descending motion of the piston the air can be jetted into the combustion chamber through the decompressing hole enough to serve as a third scavenging gas. At this time, the air-fuel mixture purged from the decompressing hole into the delivery passage during the ascending motion of the piston can be jetted into the combustion chamber together with the air fed through a free end opening of the delivery passage.

Preferably, an insulator is provided between a fuel suppling device and a cylinder block, and the decompressing hole is disposed in the cylinder block at a location confronting to the insulator so that removal of the insulator can result in exposure of the decompressing hole.

According to this preferred embodiment, even though the decompressing hole is likely to be clogged, removal of the insulator member allows the decompressing hole to be exposed to the outside and, therefore, the cleaning of the decompressing hole can easily be accomplished, thus eliminating the clogging of the decompressing hole.

The decompressing hole referred to above may be oriented upwardly towards the combustion chamber.

Orientation of the decompressing hole in an upward direction is effective to allow the air, introduced from the delivery passages into the combustion chamber through the decompressing hole, to guide the air-fuel mixture, subsequently introduced into the combustion chamber, so as to efficiently guide the air-fuel mixture towards the ignition plug, positioned above the combustion chamber, thereby enriching the air-fuel mixture in the vicinity of the ignition plug P with the stabilization of ignition of the air-fuel mixture consequently increased.

In a preferred embodiment of the present invention, the delivery passage may be formed in a cylinder block, and a portion of the delivery passage, which is exposed bare to an outside, is then covered by a lid member. Preferably, the decompressing hole is disposed in the cylinder block at a location such that removal of the lid member can result in exposure of the decompressing hole.

According to this preferred embodiment, even though the decompressing hole is likely to be clogged, removal of the lid member allows the decompressing hole to be exposed to the outside and, therefore, the cleaning of the decompressing hole can easily be accomplished, thus eliminating the clogging of the decompressing hole.

In another preferred embodiment of the present invention, a fan may be drivingly coupled with a crankshaft of the combustion engine for producing a stream of air and the decompressing hole defined in that portion of a cylinder block is located close to the fan.

According to such another preferred embodiment, since during the operation of the combustion engine that side wall portion of the cylinder block adjacent the decompressing hole can be cooled by the stream of air from the fan at all times, an undesirable increase of the temperature in the vicinity of the decompressing hole can advantageously be suppressed. As such, the temperature in the vicinity of the decompressing hole is so relatively low that fuel deposited on the decompressing hole will hardly be charred and, even though the charring occur, the amount of deposits is extremely small. Hence, the clogging of the decompressing hole can advantageously be suppressed.

In the practice of the present invention, the combustion engine of the type referred to above may also include a first scavenging passage communicating the combustion chamber to a crank chamber for supplying an air-fuel mixture within the crank chamber towards the combustion chamber, and a second scavenging passage fluidly connected with the downstream opening of the delivery passage for supplying an air, introduced into the delivery passage, towards the combustion chamber. In such case, the second scavenging passage may communicate the combustion chamber with the crank chamber through a crankshaft bearing. With this arrangement a portion of the air-fuel mixture within the crank chamber can flow into the second scavenging passage through a gap between inner and outer races of the crankshaft bearing and, therefore, the crankshaft bearing can be lubricated with oil component contained in the air-fuel mixture.

Also, the combustion engine of the type referred to above may further include an air passage for introducing the air into the delivery passage. In this case, the delivery passage extends from the air passage to the second scavenging passage after having passed radially outwardly of the first scavenging passage.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described in detail with reference to the accompanying drawings.

Figure 1:
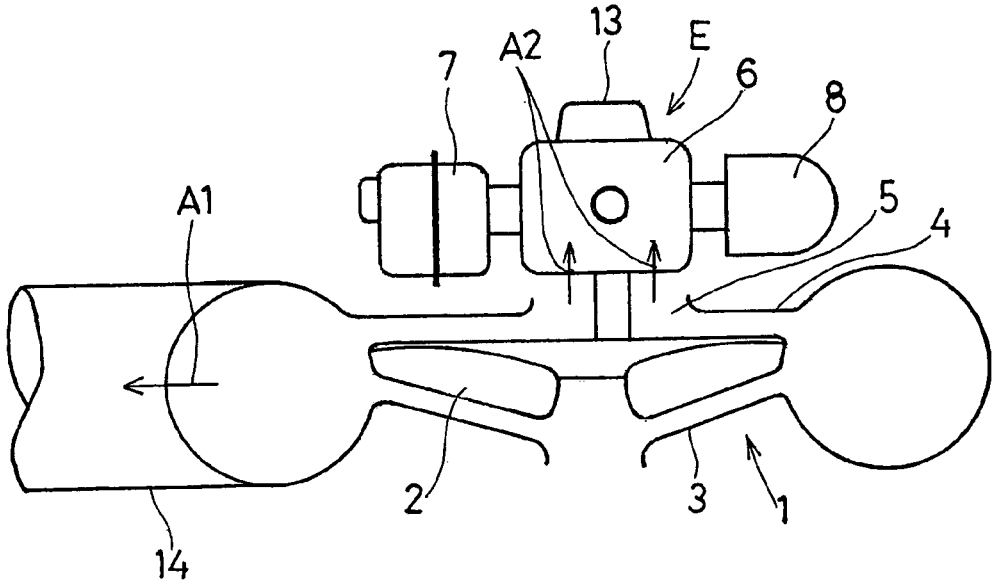
FIG. 1 is a schematic plan view of a small-size blowing machine utilizing an air scavenging type combustion engine equipped with a pressure reducing device according to a first preferred embodiment of the present invention.

Referring to FIG. 1, there is shown a schematic plan view of a small-size blowing machine utilizing an air scavenging type combustion engine equipped with a pressure reducing device according to a first preferred embodiment of the present invention. The blowing machine 1 shown in FIG. 1 includes a blower fan 2 and a fan casing 3, and a combustion engine E for driving the fan 2 is coupled with and positioned rearwardly of the fan casing 3. The combustion engine E includes a recoil starter 13 mounted on a rear face thereof and an engine cylinder block 6 positioned at a location confronting an air delivery port 5 defined in a rear wall 4 of the fan casing 3. An exhaust silencer 7 is connected with a side portion (a left side portion, as viewed in FIG. 1) of the cylinder block 6, and an air intake device 8 including a carburetor or a fuel suppling device and an air cleaner is connected with another side portion (a right side portion, as viewed in FIG. 1) of the cylinder block 6. A large portion A1 of the current of air induced by the fan 2 is supplied to the outside through a duct 14 and the remaining portion thereof is supplied as a cooling air A2 to the combustion engine E through the air delivery port 5.

Figure 2:
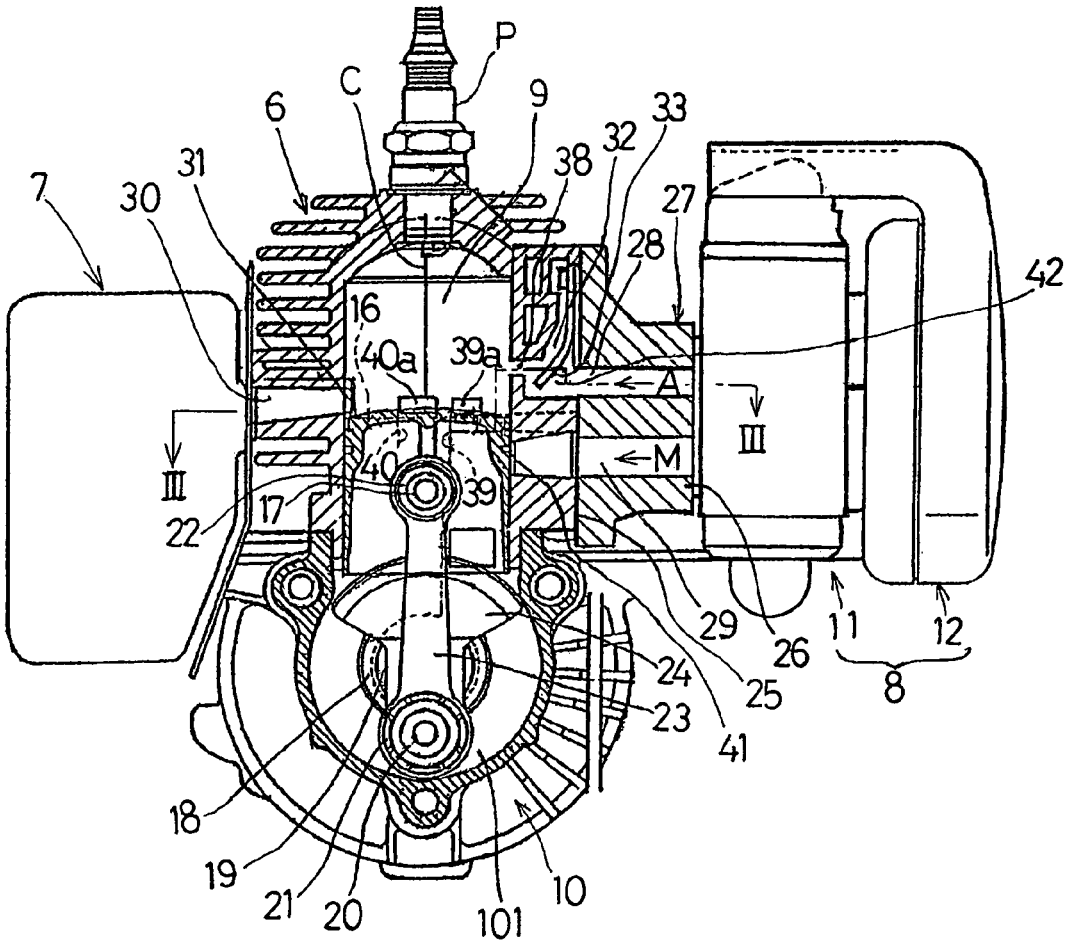
FIG. 2 is a front sectional view of the air scavenging type combustion engine equipped with the pressure reducing device.

FIG. 2 is a front sectional view of the combustion engine E. As shown therein, the cylinder block 6 having a combustion chamber 9 defined therein is fixedly mounted on a crankcase 10. The cylinder block 6 and the crankcase 10 are made of a metallic material such as, for example, aluminum and are formed by the use of any known metal casting technique. The carburetor 11 and the air cleaner 12, forming respective parts of the air intake device 8 as described previously, are connected with the right side portion of the cylinder block 6, and the exhaust silencer 7 referred to previously is connected with the left side portion of the cylinder block 6.

Within a cylinder bore defined in the cylinder block 6, a reciprocating piston 16 is accommodated for reciprocating movement in an axial direction of the cylinder bore, for example, in a vertical direction so far as in the illustrated embodiment. This reciprocating piston 16 is in turn drivingly coupled with a crankshaft 19, rotatably supported within the crankcase 10 by means of crankshaft bearings 18, through a connecting rod 23. Specifically, a portion of the crankshaft 19 offset laterally form the longitudinal axis of the crankshaft 19 is provided with a hollow crankpin 20, and the connecting rod 23 having big and small end bearings 21 and 22 is connected at the big end bearing 21 with the crankpin 20 and at the small end bearing 22 with the reciprocating piston 16. The crankshaft 19 has a crank web 24 mounted therein, and an ignition plug P is mounted atop the cylinder block 6.

An insulator 27 for insulating heat transmission from the cylinder block 6 tending to evolve high temperatures is provided between the cylinder block 6 and the carburetor 11 or the fuel suppling device through sealing gaskets 25 and 26 that are positioned on respective sides of the insulator 27. This insulator 27 has an air passage 28 defined therein and, also, an air-fuel mixture passage 29 defined therein at a location beneath the air passage 28 so as to extend parallel to such air passage 28.

The carburetor 6 includes a single rotary valve and is of a design, in which respective cross-sectional areas of the air passage 28 and the air-fuel mixture passage 29 can be regulated or varied by the single rotary valve. The cylinder block 6 has a peripheral wall formed with an exhaust passage 30 communicated with the cylinder bore through an exhaust port 31, and exhaust gases (combustion gases) produced within the combustion chamber 9 can be exhausted to the outside through this exhaust passage 30 by way of the exhaust silencer 7.

Figure 3:
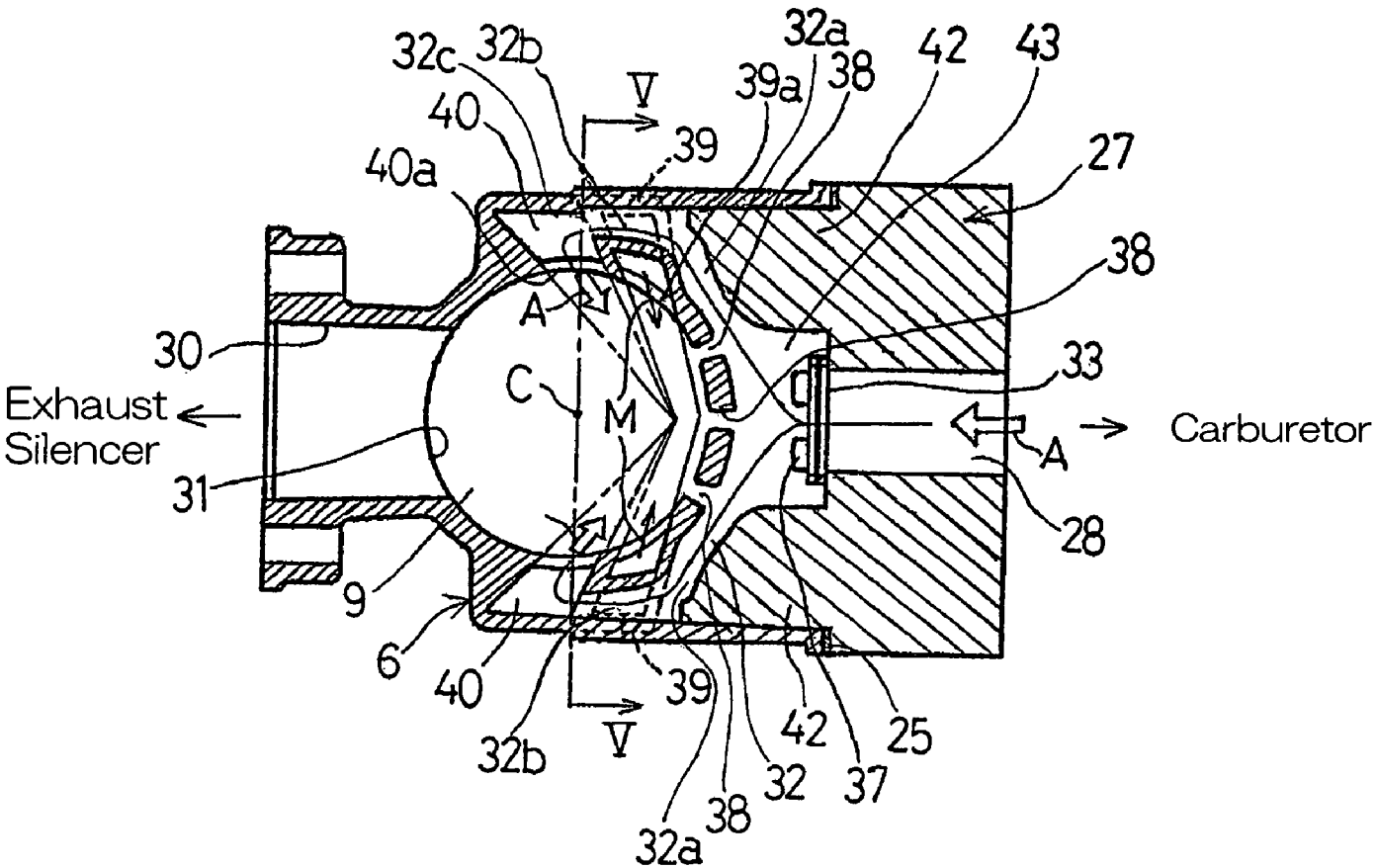
FIG. 3 is a cross-sectional view taken along the line III—III in FIG. 2.

First scavenging passages 39 for fluidly connecting the combustion chamber 9 directly with a crank chamber 101 and second scavenging passages 40 for fluidly connecting the combustion chamber 9 with the crank chamber 101 through the crankshaft bearings 18 (best shown in FIG. 5) are defined so as to extend through the cylinder block 6 and the crankcase 10. Each pair of the fist and second scavenging passages 39, 40 are positioned symmetrically on respective sides of the longitudinal axis of the exhaust passage 30 as best shown in FIG. 3 showing a cross-sectional view taken along the line III—III in FIG. 2. The second scavenging passages 4 are disposed at respective locations closer to the exhaust port 31 than to the first scavenging passages 39. As shown in FIG. 2, the first and second scavenging passages 39 and 40 have respective upper open ends defining first and second scavenging ports 39*a* and 40*a*. Those first and second scavenging ports 39*a* and 40*a* open in an inner peripheral surface of the cylinder block 6 in communication with the cylinder bore and are so positioned relative to each other that upper edges of the second scavenging ports 40*a* occupy a position higher than those of the first scavenging ports 39*a* and lower than an upper edge of the exhaust port 31.

A stream of air A flowing through the air passage 28 in the insulator 27 is, during the intake stroke at which the reciprocating piston 16 ascends, introduced temporarily into the second scavenging passages 40 through delivery passages 32, as will be described later with reference to FIG. 3, by the effect of a negative pressure developed inside the crank chamber 101. On the other hand, an air-fuel mixture M containing oil component and flowing through the air-fuel mixture passage 29 is, when the reciprocating piston ascends during the intake stroke, introduced directly into the crank chamber 101 through an intake port 41, defined in the inner peripheral surface of the cylinder block 6 in communication with the cylinder bore, by the effect of the negative pressure inside the crank chamber 101.

Figure 4:
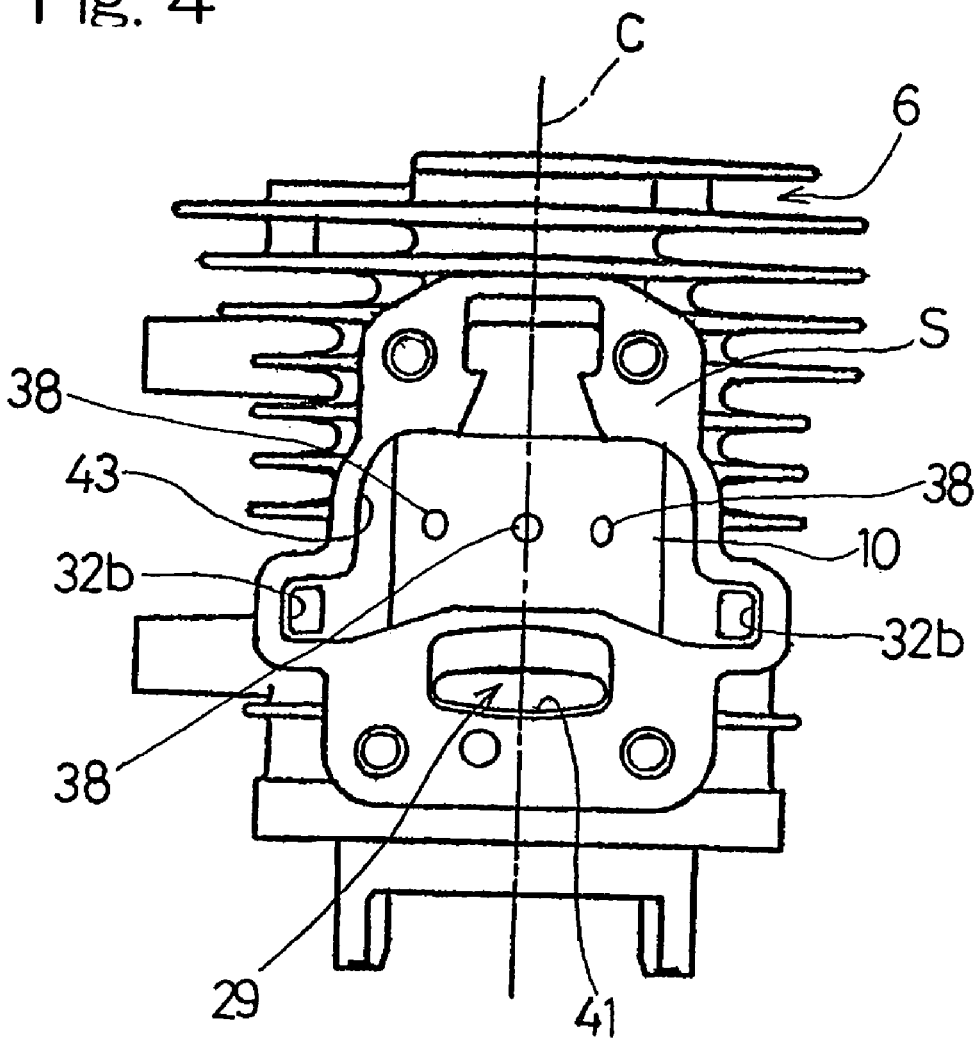
FIG. 4 is a side view of the air scavenging type combustion engine, showing an engine cylinder block thereof.

As shown in FIG. 3, the delivery passages 32 referred to above are defined within the cylinder block 6 for fluidly connecting the air passage 28 in the insulator 27 with the second scavenging passages 40. The insulator 27 is formed integrally with a pair of protrusions 42 protruding into the cylinder block 6 and forming respective parts of walls defining the delivery passages 32. As shown in FIGS. 3 and 4, the cylinder block 6 has a recess 43 formed therein for defining the delivery passages 32. This recess 43 can be conveniently formed simultaneously with casting of the cylinder block 6 so as to deplete a portion of the cylinder block 6 counter to the exhaust port 31 in a direction parallel to the air passage 28. The protrusions 42 referred to above protrude into the recess 43 to define respective upstream passage portions 32*a* of the delivery passages 32.

Respective downstream passage portions 32*b* of the delivery passages 32 continuing to the upstream passage portions 32*a* are defined in a region deep in the recess 43 and on respective lateral sides of the longitudinal axis of the exhaust passage 30 so as to extend radially outwardly of the corresponding first scavenging passages 39, terminating in communication with the second scavenging passage 40. Thus, the recess 43 form respective parts of or the entirety of inner surfaces of the delivery passages 32 over the entire lengths of the delivery passages 32 that conform to the direction of flow of the air A.

The air passage 28 in the insulator 27 has a delivery port defined at a downstream end thereof with respect to the direction of flow of the air A, which delivery port is provided with a reed valve 33 secured to the insulator 27 by the use of screw elements 37. This reed valve 33 is operable to open the air passage 28 when the pressure inside the delivery passage 32 attains a value lower than a predetermined value.

Figure 5:
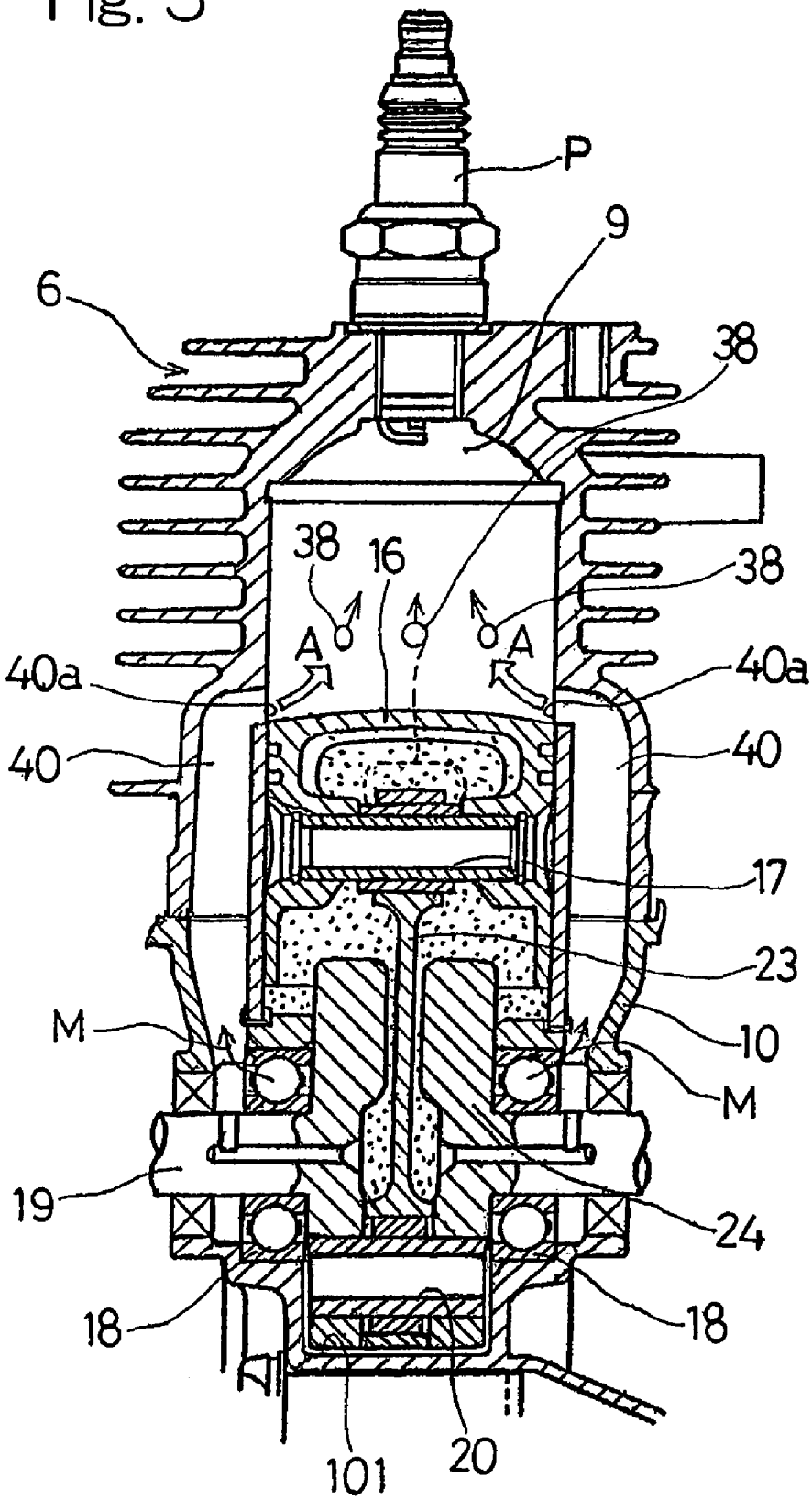
FIG. 5 is a cross-sectional view taken along the line V—V in FIG. 3, showing the combustion engine under the scavenging stroke.

The air A introduced into the second scavenging passages 40 through the delivery passages 32 by way of respective downstream ends 32*c* of the delivery passages 32 is, as shown in FIG. 5, blown into the combustion chamber 9 through the second scavenging passages 40*a* during the scavenging stroke in which the reciprocating piston 16 descends.

Three decompressing holes 38 for communicating the delivery passages 32 to the combustion chamber 9 are formed at a location circumferentially opposite to the exhaust port 31 in the cylinder block 6 and confronting to the insulator 27. Each decompressing hole 38 is positioned above the upper edge of the exhaust port 31 so that all of those decompressing holes 38 can be closed by the reciprocating piston 16, then moving upwardly, at a timing delayed relative to the timing of closure of the exhaust port 31.

In the illustrated embodiment, as best shown in FIG. 3, those three decompressing holes 38 are defined in a portion of the wall surface of the cylinder block 6 confronting the exhaust port 31 and portions on respective sides of that portion thereof confronting the exhaust port 31, so that generally intermediate portions of the delivery passages 32 can be communicated with the combustion chamber 9. However, if so desired, only the intermediate decompressing hole 38 at that portion of the wall surface of the cylinder block 6 confronting the exhaust port 31 other than the intermediate decompressing hole 38 may be employed. In any event, the number of the decompressing holes 38 may be determined in consideration of various conditions including, for example, the engine displacement, the extent to which the pressure is desired to be reduced and others.

As FIG. 4 makes it clear, a downstream portion of the air-fuel mixture passage 29 is formed at a location beneath the recess 43 opening at an outer peripheral surface of the cylinder block 6, and an exit thereof defines a fuel intake port 41 opening at the inner peripheral surface of the cylinder block 6.

Figure 6:
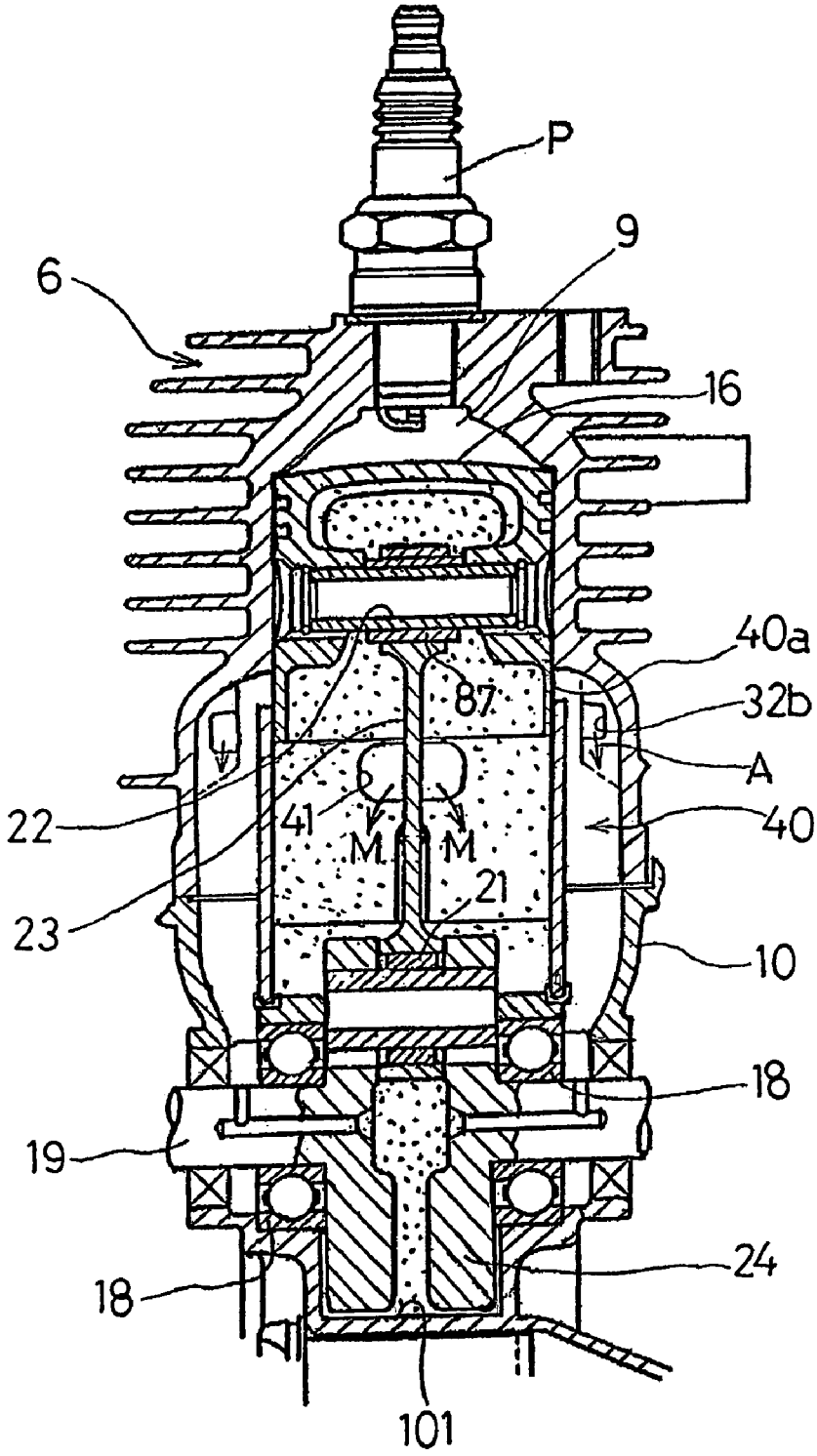
FIG. 6 is a view similar to FIG. 5, showing the combustion engine under the compression and intake stroke.

The operation of the combustion engine E of the structure described hereinbefore will now be described. When the reciprocating piston 16 within the cylinder bore of the cylinder block 6 then under the compression and intake stroke reaches the top dead center position as shown in FIG. 6 and the negative pressure is therefore developed inside the cylinder block 6 and the crank chamber 101, the air-fuel mixture M is introduced directly into the crank chamber 101 through the fuel intake port 41 open at the inner peripheral surface of the cylinder block 6. The air-fuel mixture so introduced into the crank chamber 101 lubricates the big and small end bearings 21 and 22 of the connecting rod 23. At this time, since the second scavenging passages 40 communicated with the crank chamber 101 through the crankshaft bearings 18 is also held under negative pressure, the negative pressure is introduced into the delivery passages 32, shown in FIG. 2 and communicated with the second scavenging passages 40. By the effect of the negative pressure inside the delivery passages 32, the reed valve 33 secured to the delivery port of the air passage 28 in the insulator 7 is opened, allowing the air A in the air passage 28 to be temporarily introduced into the second scavenging passages 40 through the delivery passages 32.

When as described above, the reed valve 33 is opened by the effect of the negative pressure inside the crank chamber 101 shown in FIG. 2 during the intake stroke, the air A is introduced into the second scavenging passages 40 at all times. For this reason, a sufficient amount of air necessary to avoid the blow-off of the air-fuel mixture can be secured within the second scavenging passages 40.

During the subsequent scavenging stroke, as shown in FIG. 3, the air-fuel mixture M and the air A are supplied into the combustion chamber 9 through the first and second scavenging ports 39*a* and 40*a* of the first and second scavenging passages 39 and 40, respectively, different timings. Specifically, the air A is first introduced into the combustion chamber 9 through the second scavenging ports 40*a* and the air-fuel mixture M is then supplied into the combustion chamber 9 through the first scavenging port 39*a* at a slightly delayed timing. Considering that the air A is supplied into the combustion chamber 9 slightly earlier than the air-fuel mixture M and that the air A so supplied enters the combustion chamber 9 at a location closer to the exhaust port 31 than the air-fuel mixture M does, the air A supplied into the combustion chamber 9 effectively operates to prevent the air-fuel mixture M from being blown off from the exhaust port 31.

When the air A is introduced into the combustion chamber 9 through the second scavenging passages 40 shown in FIG. 5, a portion of the air-fuel mixture M within the crank chamber 101 flows into the second scavenging passages 40 through a gap between inner and outer races of each of the crankshaft bearings 18 and, therefore, the crankshaft bearings 18 can be lubricated with the oil component contained in the air-fuel mixture M.

Also, in the foregoing embodiment, when the reciprocating piston 16 ascends from the bottom dead center position shown in FIG. 5 with the combustion engine E consequently held under the compression stroke, formation of the decompressing holes 38 at a predetermined location allows the air-fuel mixture M, being then compressed within the combustion chamber 9, is driven into the delivery passage 32 shown in FIG. 2 through the decompressing holes 38 to thereby suppress an increase of the pressure inside the combustion chamber 9. Accordingly, since an increase of the temperature inside the combustion chamber 9 is suppressed, when the ignition switch is turned off after the combustion engine E then operated under the full open condition is pulled down to an idling speed, the increase of the temperature of the air-fuel mixture M within the combustion chamber 9 is suppressed and will not attain a value equal to the temperature of self-ignition of the air-fuel mixture M and, therefore, "run-on" phenomenon will be prevented.

Also, even though the fuel containing the oil component is deposited in the vicinity of the decompressing holes 38 to such an extent as to result in clogging, removal of the insulator 27 can result in exposure of the decompressing holes 38 to the outside as can readily be understood from FIG. 3 and, therefore, the clogging can relatively easily be removed by an operator cleaning work. In addition, since for preventing "run-on", a simple means such as formation of the decompressing holes 38, not a complicated and expensive means such as cutting of the fuel, is employed and, therefore, the cost can advantageously be reduced. Yet, since the driving torque can be reduced by the pressure reduction, an operating force required by the recoil starter 12 shown in FIG. 1 can advantageously be reduced and the starting can easily be accomplished.

As shown in FIG. 3, the decompressing holes 38 are defined at a location confronting the exhaust port 31 as hereinbefore described. Accordingly, the air-fuel mixture M expelled through the decompressing holes 38 into the air passage 28 can be introduced into the combustion chamber 9 together with the air A flowing through the decompressing holes 38 during the scavenging stroke in which the reciprocating piston 176 descends, thereby forming a third scavenging gas, which contributes to expelling of the combustion gases through the exhaust port 31.

Figure 7:
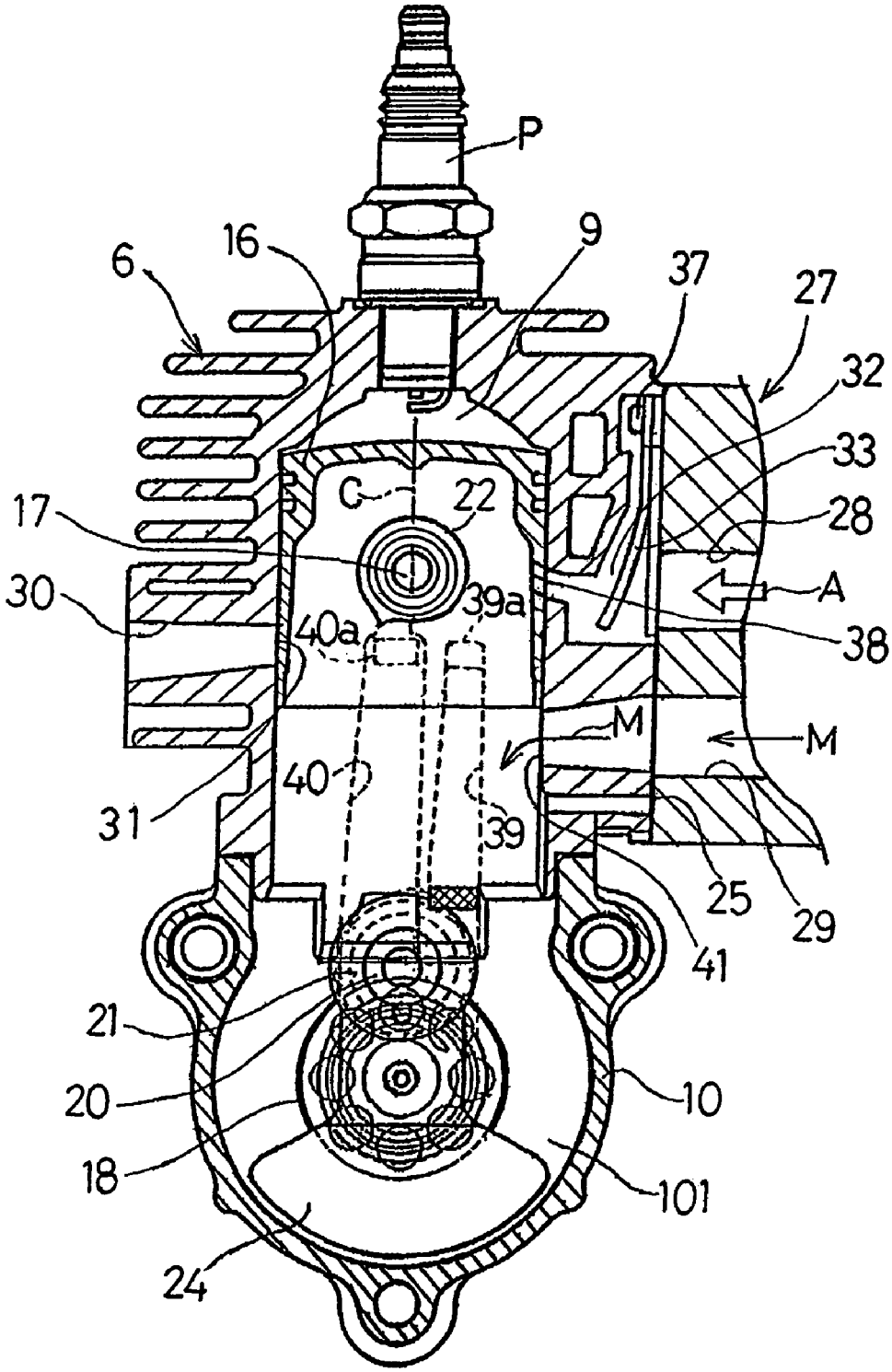
FIG. 7 is a front sectional view of the air scavenging type combustion engine, showing a modification thereof.

Referring now to FIG. 7 showing a modified form of the combustion engine E, each of the decompressing holes 38 may be upwardly oriented towards the combustion chamber 9 as shown therein. Orientation of the decompressing holes 38 in an upward direction is effective to allow the air A, introduced from the delivery passages 32 into the combustion chamber 9 through the decompressing holes 38, to guide the air-fuel mixture M, subsequently introduced into the combustion chamber 9, so as to efficiently guide the air-fuel mixture M towards the ignition plug P, positioned above the combustion chamber 9, during the scavenging stroke, thereby enriching the air-fuel mixture M in the vicinity of the ignition plug P. Accordingly, the stabilization of ignition of the air-fuel mixture M can advantageously be increased.

Figure 8:
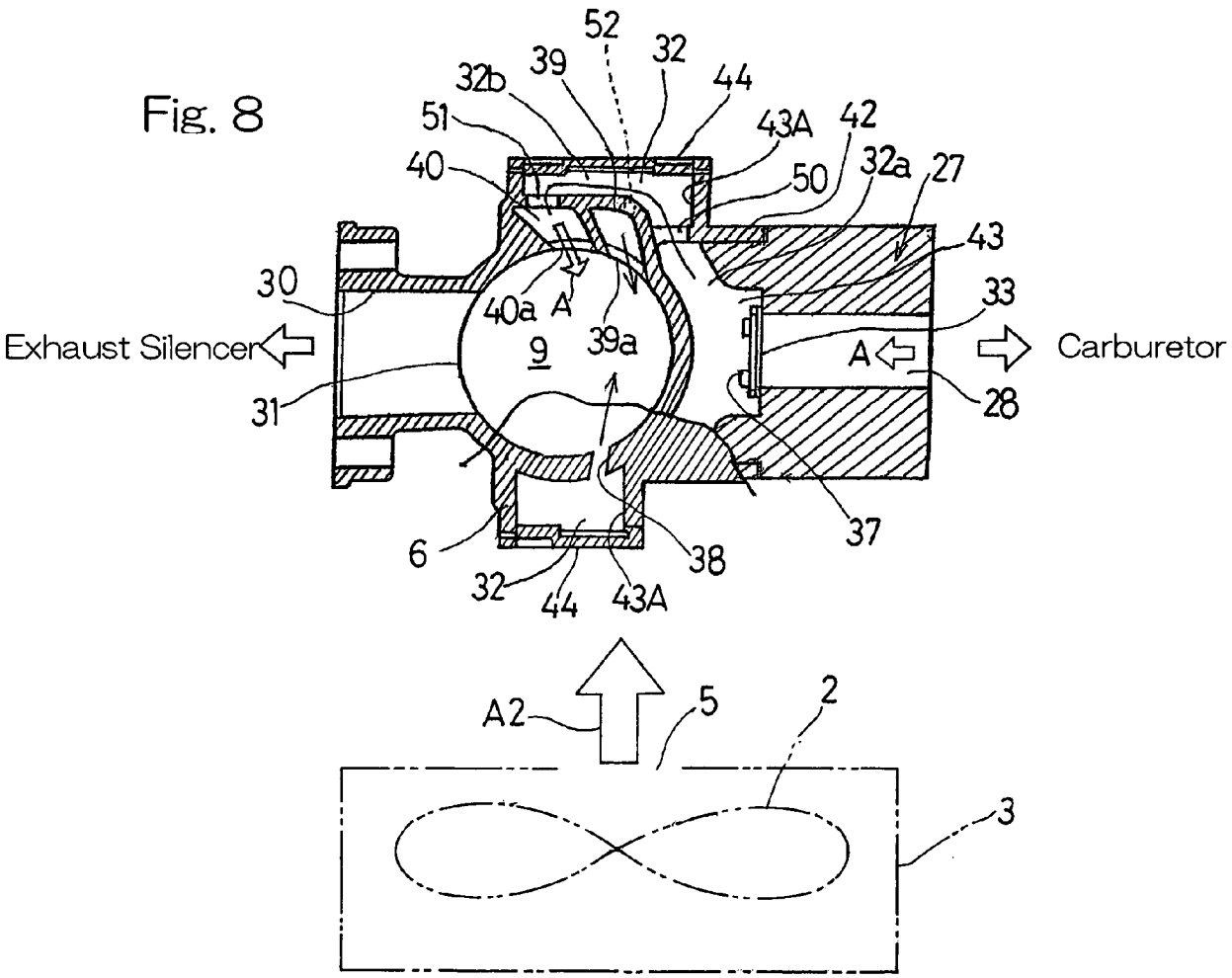
FIG. 8 is a view similar to FIG. 3, showing an essential portion of the air scavenging type combustion engine having the pressure reducing device according to a second preferred embodiment of the present invention.
Figure 9:
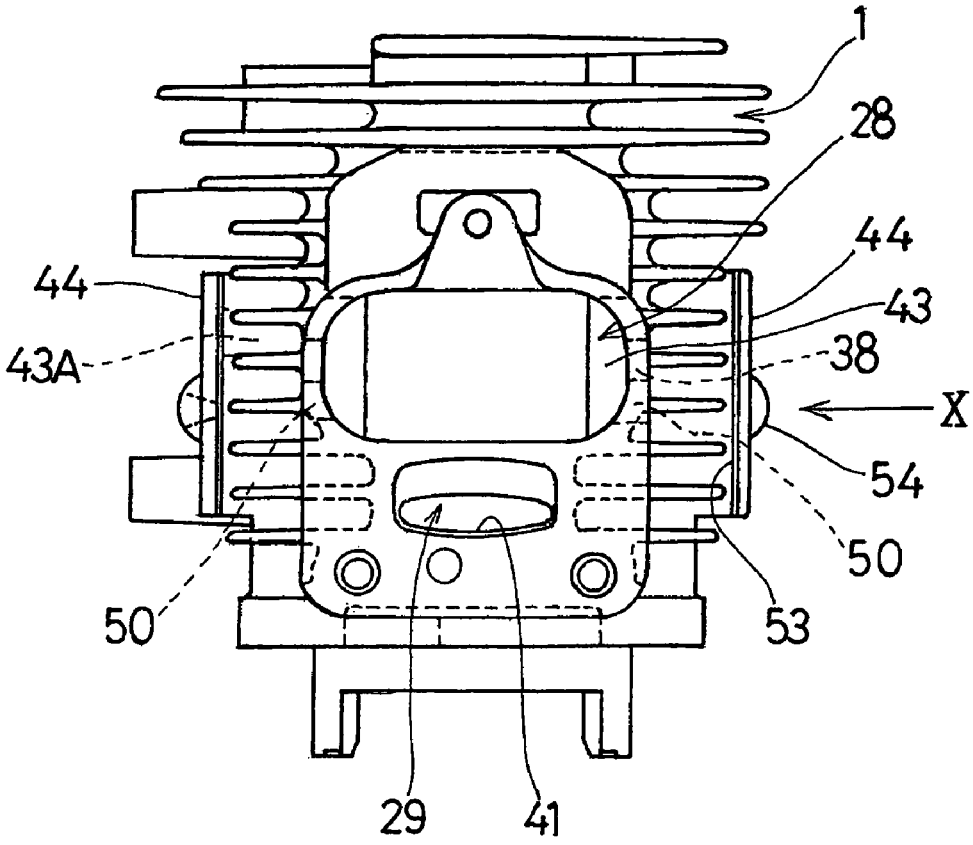
FIG. 9 is a side view of the air scavenging type combustion engine shown in FIG. 8, showing the engine cylinder block thereof.
Figure 10:
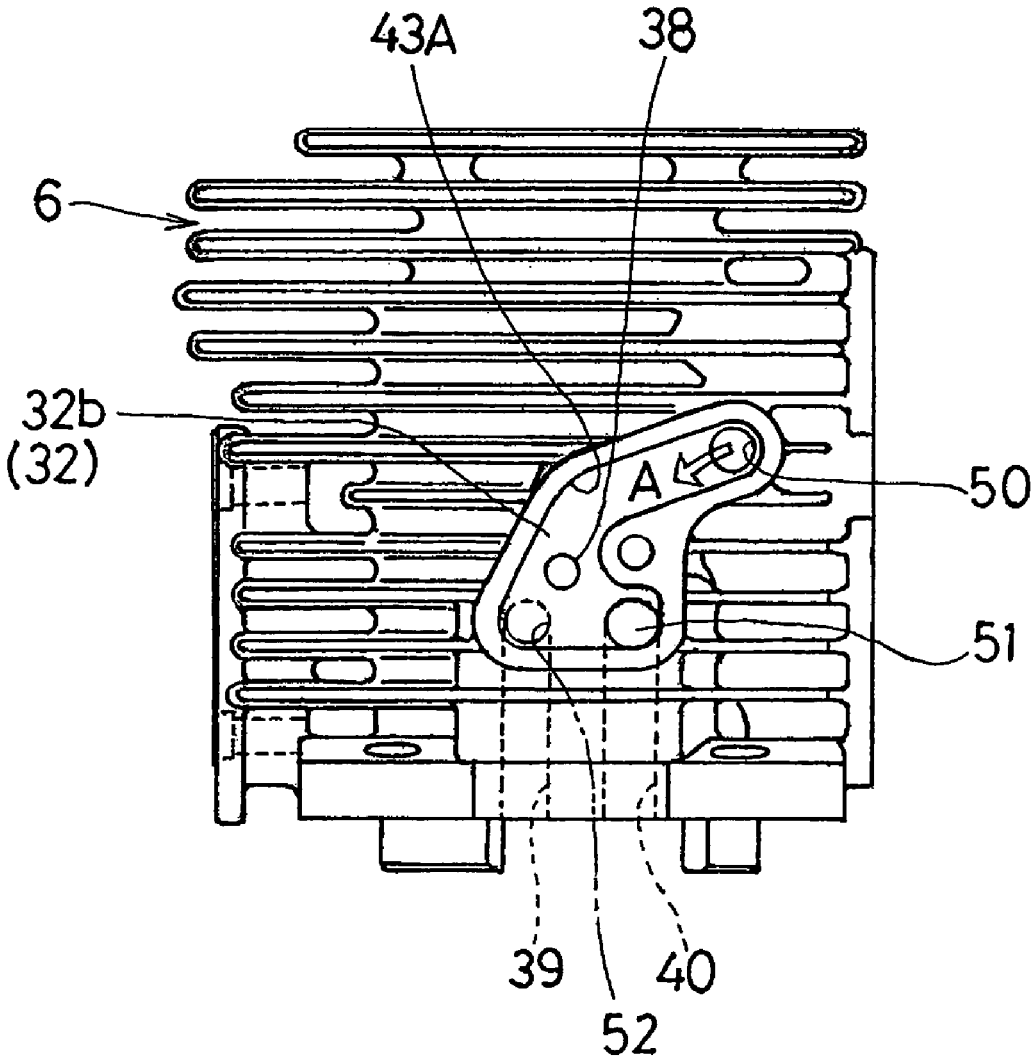
FIG. 10 is a different side view of the air scavenging type combustion engine shown in FIG. 8, as viewed from a different direction shown by the arrow X in FIG. 9, with a lid member removed.

The air scavenging type combustion engine having the pressure reducing device according to a second preferred embodiment of the present invention will now be described with particular reference to FIGS. 8 to 10. The combustion engine shown in FIGS. 8 to 10 is substantially similar to that shown in and described with reference to FIGS. 1 to 6, except that in this embodiment, in addition to the insulator 27 formed integrally with a pair of protrusions 42 protruding into the cylinder block 6 and forming respective parts of walls defining the delivery passages 32, lid members 44, shown in FIG. 8, forming respective parts of walls of the delivery passage 32 are secured to side wall portions of the cylinder block 6. Other structural features of the combustion engine than this exception are similar to those in the first embodiment of the present invention and, therefore, they are not reiterated for the sake of brevity.

In addition to a first recess 43 communicated with the air passage 28 through the reed valve 33, the cylinder block 6 is formed with second recesses 43A positioned radially outwardly of the first and second scavenging passages 39 and 40, respectively, which recesses 43A are closed by the respective lid members 44 to define corresponding downstream passage portions 32*b* of the air delivery passages 32. The air A from the air passage 28 is, when the reed valve 33 is opened, introduced into the second scavenging passages 40 through the delivery passages 32 by way of air delivery ports 51. Upstream and downstream passage portions 32*a* and 32*b* of each of the delivery passages 32 are communicated with each other through a communicating hole 50 defined in the cylinder block 6. The flow of the air A and the air-fuel mixture M during the intake stroke and that during the scavenging stroke are similar to those described in connection with the first embodiment of the present invention and, therefore, they are not reiterated for the sake of brevity.

As hereinbefore described, each of the lid members 44 covers a portion of the corresponding delivery passage 32 that is remote from the cylinder bore and is exposed bare to the outside of the cylinder block 6. The decompressing hole 38 is formed in a wall portion adjacent to the cylinder bore and opposite to that portion of the delivery passage 32 that is exposed to the outside of the cylinder block 6 and is closed by the corresponding lid member 44. Accordingly, removal of the lid member 44 from the cylinder block 6 results in exposure of the decompressing hole 38.

As shown in FIGS. 8 and 9, the first recess 43 opening at the lateral side portion of the cylinder block 6 and forming an upstream passage portion 32*a* of the delivery passages 32 has a width smaller than the recess 43 employed the first embodiment of the present invention. The lid members 44 are fixed to front and rear surface areas of the cylinder block 6 by means of screw elements 54 with respective gaskets 53 intervening between the lid members 44 and the cylinder block 6.

The decompressing hole 38 is defined in a portion of the wall of the cylinder block 6, to which a stream of cooling air A2 induced by the fan 2 collides, that is, adjacent the fan 2, or a lower portion of the cylinder block wall as viewed in FIG. 8, and is not formed in an upper portion of the wall of the cylinder block 6. However, the decompressing hole 38 may be formed in the upper portion of the wall of the cylinder block 6 as viewed in FIG. 8.

FIG. 10 is a side view of the air scavenging type combustion engine as viewed from a direction shown by the arrow X in FIG. 9, with one of the lid members 44 removed. As shown therein, each of the second recesses 43A formed in the cylinder block 6 has, in addition to the communicating hole 50, the air delivery port 51 defined therein in communication with the corresponding second scavenging passage 40, and a portion of the delivery passage 32 between the communicating hole 50 and the air delivery port 51 defines a downstream passage portion 32*b*. Accordingly, the air A can be introduced from the communicating holes 50 into the second scavenging passages 40 through the downstream passage portions 32*b* of the delivery passages 32 and then through the air delivery ports 51, each forming a downstream opening of the corresponding delivery passage 32, respectively.

Thus, the first and second recesses 43 and 43A form respective parts of inner surfaces of the delivery passages 32 over the entire lengths of the delivery passages 32 that conform to the direction of flow of the air A. The decompressing hole 38 referred to above is so formed at a location between the communicating hole 50 and the air delivery port 51 as to fluidly connect between the delivery passage 32 and the combustion chamber 9 as shown in FIG. 8.

It is, however, to be noted that where an additional delivery port 52 communicating between the first scavenging passage 39 and the delivery passage 32 is employed as shown by the phantom line in FIG. 10, it is possible to allow the air A to be sucked into not only the second scavenging passage 40, but also the first scavenging passage 39. By so doing, it is possible to allow the air A to be jetted from the first scavenging passage 39, shown in FIG. 8, at the initial timing at which the air-fuel mixture M is jetted and, therefore, the blow-off of the air-fuel mixture M can be effectively suppressed.

According to the second embodiment of the present invention, not only can effect similar to those afforded by the previously described first embodiment be obtained, but the following effects can also be obtained. Specifically, since the decompressing hole 38 is formed in that portion of the wall of the cylinder block 6, where the stream of air A2 induced by the fan 2 collides, and those exposed portions of the delivery passages 32 are covered by the respective lid members 44, during the operation of the combustion engine the decompressing hole 38 is indirectly cooled by the stream of cooling air A2 from the fan 2 then colliding against the lid members 44, with the increase of the temperature of and in the vicinity of the decompressing hole 38 suppressed consequently. Accordingly, fuel deposited in and around the decompressing hole will hardly be charred and, even though charred, the amount of the deposit is small. Also, even when any deposit is formed in the vicinity of the decompressing hole 38, since the lid members 44 can easily be removed as compared with the insulator 27 employed in the previously described first embodiment, removal of the lid members 44 can facilitate the cleaning of the decompressing hole 38 to thereby avoid clogging.

As a development of the present invention, the respective passages 28 and 29 in FIG. 2, through which the air A and the air-fuel mixture M flow, may be reversed to those shown and described. In other words, the air passage 28 and the air-fuel mixture passage 29 may be reversed in vertical positions relative to each other. In such case, the decompressing hole 38 has to be used to communicate between a delivery passage for the air-fuel mixture M and the combustion chamber 9 for reducing the pressure.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention.

Accordingly, such changes and modifications are, unless they depart from the scope of the present invention as delivered from the claims annexed hereto, to be construed as included therein.

What is claimed is:

1. In a two-cycle combustion engine with an air scavenging system, the improvement of a pressure reducing device, in the combustion engine, comprising:

a delivery passage for introducing air into a combustion chamber prior to an air-fuel mixture, the delivery passage having a downstream opening through which the air is introduced into the combustion chamber by way of a scavenging port; and a decompressing hole defined for communicating the combustion chamber to a portion of the delivery passage;

the decompressing hole being closed by a piston then ascending, at a timing delayed relative to closure of an exhaust port, wherein the decompressing hole is defined at a position confronting the exhaust port.

2. The two-cycle combustion engine with the air scavenging system as claimed in claim 1, further comprises a cylinder block, a fuel supplying device and an insulator provided between the fuel supplying device and the cylinder block, and wherein the decompressing hole is disposed in the cylinder block at a location confronting to the insulator so that removal of the insulator can result in exposure of the decompressing hole.

3. The two-cycle combustion engine with the air scavenging system as claimed in claim 2, the decompressing holes is employed in a plural number.

4. The two-cycle combustion engine with the air scavenging system as claimed in claim 1, wherein the decompressing hole is oriented upwardly towards the combustion chamber.

5. The two-cycle combustion engine with the air scavenging system as claimed in claim 1, further comprising a first scavenging passage communicating the combustion chamber to a crank chamber for supplying an air-fuel mixture within the crank chamber towards the combustion chamber, and a second scavenging passage fluidly connected with the downstream opening of the delivery passage for supplying an air, introduced into the delivery passage, towards the combustion chamber.

6. The two-cycle combustion engine with the air scavenging system as claimed in claim 5, wherein the second scavenging passage communicates the combustion chamber with the crank chamber through a crankshaft bearing.

7. The two-cycle combustion engine with the air scavenging system as claimed in claim 5, further comprising an air passage for introducing the air into the delivery passage and wherein the delivery passage extends from the air passage to the second scavenging passage after having passed radially outwardly of the first scavenging passage.

8. In a two-cycle combustion engine with an air scavenging system, the improvement of a pressure reducing device, in the combustion engine, comprising:

a delivery passage formed in a cylinder block for introducing air into a combustion chamber prior to an air-fuel mixture, the delivery passage having a downstream opening through which the air is introduced into the combustion chamber by way of a scavenging port;

a decompressing hole defined for communicating the combustion chamber to a portion of the delivery passage, the decompressing hole being closed by a piston then ascending, at a timing delayed relative to closure of an exhaust port; and a lid member for covering a portion of the delivery passage, which is exposed bare to an outside when the lid member is removed.

9. The two-cycle combustion engine with the air scavenging system as claimed in claim 8, wherein the decompressing hole is disposed in the cylinder block at a location such that removal of the lid member can result in exposure of the decompressing hole.

10. The two-cycle combustion engine with the air scavenging system as claimed in claim 9, further comprising a fan drivingly coupled with a crankshaft of the combustion engine for producing a stream of air and wherein the decompressing hole is defined in a portion block close to the fan.

11. In a two-cycle combustion engine with an air scavenging system, the improvement of a pressure reducing device in the combustion engine, comprising:

a delivery passage for introducing air into a combustion chamber prior to an air-fuel mixture, the delivery passage having a downstream opening through which the air is introduced into the combustion chamber by way of a scavenging port;

a decompressing hole defined for communicating the combustion chamber to a portion of the delivery passage, the decompressing hole being closed by a piston then ascending, at a timing delayed relative to closure of an exhaust port;

a first scavenging passage communicating the combustion chamber to a crank chamber for supplying an air-fuel mixture within the crank chamber towards the combustion chamber; and a second scavenging passage fluidly connected with the downstream opening of the delivery passage for supplying an air, introduced into the delivery passage, towards the combustion chamber.

12. The two-cycle combustion engine with the air scavenging system as claimed in claim 11, wherein the second scavenging passage provides communication between the combustion chamber and the crank chamber through a crankshaft bearing.

13. The two-cycle combustion engine with the air scavenging system as claimed in claim 11, further comprising an air passage for introducing the air into the delivery passage and wherein the delivery passage extends from the air passage to the second scavenging passage after having passed radially outwardly of the fist scavenging passage.

14. The two-cycle combustion engine with the air scavenging system as claimed in claim 11, wherein the decompressing hole is oriented upwardly towards the combustion chamber.

* * * * *